US005423894A

United States Patent [19]

Child et al.

[11] Patent Number: 5,423,894

[45] Date of Patent: Jun. 13, 1995

[54] PARTIAL OXIDATION OF LOW RANK COAL

[75] Inventors: Edward T. Child, Tarrytown; William L. Lafferty, Jr., Hopewell Junction; Motasimur R. Khan, Wappingers Falls, all of N.Y.

[73] Assignee: Texaco Inc., White Plains, N.Y.

[21] Appl. No.: 56,089

[22] Filed: May 3, 1993

[51] Int. Cl.[6] ..... C10J 3/46

[52] U.S. Cl. ..... 48/200; 48/202; 48/206; 48/209; 48/DIG. 7; 252/373

[58] Field of Search ..... 44/301, 302, 580, 280–282; 48/197 R, 200, 201, 202, 206, 209, 210, DIG. 7; 252/313; 60/39.02

[56] References Cited

U.S. PATENT DOCUMENTS

| | | | |
|---|---|---|---|
| 2,949,350 | 8/1960 | Heinze et al. | 44/282 |
| 3,607,156 | 9/1971 | Schlinger et al. | 48/206 |
| 3,866,411 | 2/1975 | Marion et al. | 48/215 |
| 3,996,026 | 12/1976 | Cole | 44/282 |
| 4,104,035 | 8/1978 | Cole et al. | 48/202 |
| 4,132,065 | 1/1979 | McGann | 60/39.02 |
| 4,166,802 | 9/1979 | Slater et al. | 48/202 |
| 4,277,365 | 7/1981 | Paull et al. | 252/373 |
| 4,309,192 | 1/1982 | Kubo et al. | 44/282 |
| 4,478,603 | 10/1984 | Mark | 44/281 |
| 4,552,568 | 11/1985 | Igarachi et al. | 44/280 |
| 4,666,464 | 5/1987 | Najjar et al. | 48/202 |
| 4,697,413 | 10/1987 | Pohl | 48/197 R |
| 4,705,533 | 11/1987 | Simmons | 44/282 |
| 4,713,086 | 12/1987 | Smit et al. | 44/281 |
| 4,749,381 | 6/1988 | Yaghmaie | 44/280 |
| 4,808,194 | 2/1989 | Najjar et al. | 44/280 |
| 4,950,307 | 8/1990 | Najjar et al. | 44/281 |
| 5,211,723 | 5/1993 | Khan | 48/DIG. 7 |
| 5,211,724 | 5/1993 | Khan et al. | 48/197 R |
| 5,230,211 | 7/1993 | McMahon et al. | 48/DIG. 7 |
| 5,266,085 | 11/1993 | McMahon et al. | 48/DIG. 7 |

*Primary Examiner*—Peter Kratz

*Attorney, Agent, or Firm*—George J. Darsa; Kenneth R. Priem; Jeffrey M. Greenman

[57] ABSTRACT

Pumpable aqueous slurries of low rank coal e.g. subbituminous coal and lignite having a comparatively high solids content are made by keeping the particles of coal in contact with a non-oxidizing gas e.g. nitrogen and/or $CO_2$ thereby maintaining a hydrophobic surface on the particles of coal while they are ground and dried, contacted with an aqueous slurry of liquid hydrocarbonaceous fuel which is absorbed and which coats the particles of coal, and then dried. The dried coated particles of low rank coal are mixed with water to produce a pumpable slurry having a solids content in the range of about 50 to 60 wt. %. In one embodiment, at least a portion of the water needed to produce said pumpable slurry is derived by cooling and condensing out water from the non-oxidizing gas that was used to dry the low rank coal. In still another embodiment, the dewatered non-oxidizing gas is introduced into the combustor of a gas turbine to moderate the temperature and thereby reduce the formation of $NO_x$ gases.

18 Claims, 1 Drawing Sheet

PARTIAL OXIDATION OF LOW RANK COAL

FIELD OF THE INVENTION

This invention relates to the partial oxidation of low rank coal. More particularly, it relates to a method of preparing a pumpable aqueous slurry of low rank coal e.g. subbituminous coal or lignite for burning in a partial oxidation gas generator.

The free-flow partial oxidation gasifier for the production of gaseous mixtures comprising $H_2+CO$ consumes large quantities of liquid hydrocarbonaceous and solid carbonaceous fuels. Alternate fuels are now required to replace the world's diminishing petroleum reserves, which are presently the preferred fuels for gasification. Low rank coal is abundantly present in various parts of the world. It has a heating value of about 6,800 Btu/lb for lignite and 10,500 for subbituminous coal and are relatively inexpensive. However, the use of low rank coal as a fuel for a partial oxidation gas generator has been limited in the past. This is mainly because of excessive coal and oxygen requirements per unit of syngas ($H_2+CO$) produced, environmental pollution, high water content, poor slurryability, and spontaneous ignition. These problems and others have been resolved by the subject invention.

Aqueous slurries of solid fuel are described in coassigned U.S. Pat. Nos. 3,544,291 and 3,607,156. Because of the pyrophoric nature of lignite and subbituminous coal, grinding these materials in air, such as described in the pellet-making process of U.S. Pat. No. 4,302,209 is unsuitable for preparing stable pumpable aqueous slurries as needed in the subject partial oxidation process.

SUMMARY

The subject process pertains to a process for the partial oxidation of low rank coal to produce synthesis gas, fuel gas or reducing gas which comprises:

(1) grinding low rank coal to a particle size so that 100 wt. % passes through ASTM Ell Standard Sieve Designation 425 microns, and drying said ground low rank coal to a solids content in the range of about 80 to 100 wt. % while said grinding and drying operations are in contact with a non-oxidizing gas at a temperature in the range of about 210° F. to 400° F.; and separating hot humidified non-oxidizing gas containing aromatic and saturated hydrocarbons from the dried ground low rank coal;

(2) contacting in a non-oxidizing atmosphere said ground particles of dried low rank coal from (1) with an aqueous emulsion of liquid hydrocarbonaceous fuel oil containing about 30 to 95 wt. % of water and the remainder substantially comprising liquid hydrocarbonaceous fuel oil, whereby said particles of low rank coal absorb about 5 to 20 wt % (basis wt. of dry low rank coal particles) of said aqueous emulsion of liquid hydrocarbonaceous fuel oil and are thereby coated;

(3) drying said coated particles of low rank coal from (2) by direct contact with a non-oxidizing gas at a temperature in the range of about 210° F. to 400° F. to a solids content in the range of about 80 to 100 wt. %;

(4) mixing the dried coated particles of low rank coal from (3) with water to produce a pumpable slurry having a solids content in the range of about 50 to 60 wt. %; and (5) reacting by partial oxidation with a free-oxygen containing gas in the reaction zone of a free-flow gas generator the aqueous slurry of coated particles of low rank coal from (4) to produce a stream of synthesis gas, fuel gas or reducing gas.

DISCLOSURE OF THE INVENTION

Figure 1:
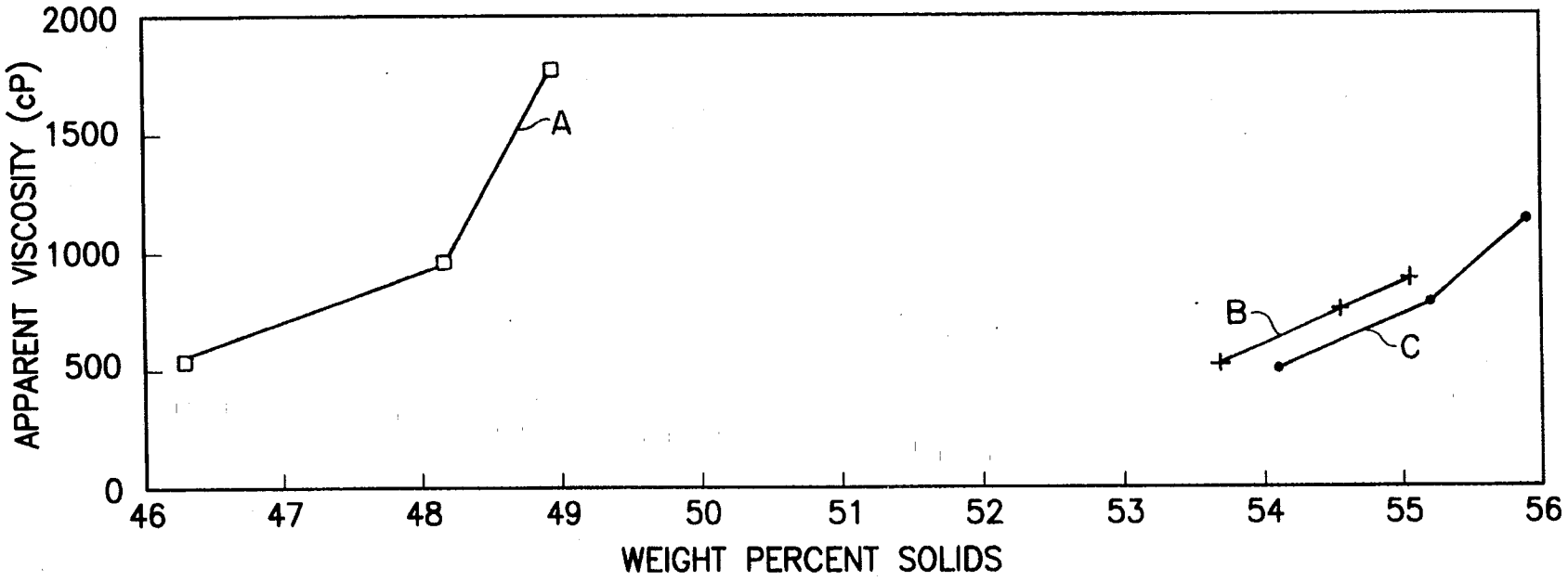
FIG. 1 shows the substantially increased amount of low rank coal solids that may be introduced into pumpable aqueous slurries by processing the low rank coal in accordance with the subject invention.

Coal is the world's most abundant and economical fossil fuel. Low rank coal e.g. subbituminous and lignite constitute a large portion of the available coal supply. While low rank coal is readily available and low in cost, because of some unfavorable physical and chemical properties its use in the past as a fuel in a partial oxidation gasifier has been discouraged. However, by the subject process, low rank coal as processed herein may now be used as an economic readily available solid carbonaceous feedstock to a partial oxidation gas generator for the production of synthesis gas, reducing gas, fuel gas, or as fuel in a boiler or furnace. The product gases from the partial oxidation gas generator may be used to produce organic chemicals, hydrogen, fertilizer, and electric power. Synthesis gas comprises various ratios of $H_2/CO$ for use in chemical synthesis. Reducing gas is rich in $H_2$ for using in reducing. Fuel gas comprises $H_2$, CO and may contain $CH_4$ and is used for heating. The term and/or is used herein in its normal manner. For example, A and/or B means A, or B, or A+B.

The term low rank coal, as used herein, pertains to Class III subbituminous and Class IV Lignitic fuel, as shown below in Table I of ASTM D388.

TABLE I

| CLASS | GROUP | CALORIFIC VALUE *BTU per pound: Equal or Greater Than | CALORIFIC VALUE *BTU per pound: Less Than | AGGLOMERATING CHARACTER |
|---|---|---|---|---|
| III | Subbituminous | | | |
| | 1. Subbituminous A coal | 10,500 | 11,500 | non-agglomerating |
| | 2. Subbituminous B coal | 9,500 | 10,500 | non-agglomerating |
| | 3. Subbituminous C coal | 8,300 | 9,500 | non-agglomerating |
| IV | Lignitic | | | |
| | 1. Lignite A | 6,300 | 8,300 | non-agglomerating |
| | 2. Lignite B | — | 6,300 | non-agglomerating |

*Moist (coal containing its natural inherent moisture but not including visible water on the surface of the coal), Mineral-Matter-Free Basis As received, low rank coal has a solids content in the range of about 60 to 90 wt. %. The low rank coal is ground to a particle size so that 100 wt. % passes through ASTM E11 Standard Sieve Designation 425 microns. It is preferably ground and dried while in contact with a non-oxidizing gas at a temperature in the range of about 210° F. to 400° F., such as about 250° F. to 350° F., to a solids content in the range of about 80 to 100 wt. %. The non-oxidizing gas is in contact with the low rank coal during the entire time that it passes through the grinding mill e.g. for a period in the range of about 2 to 60 minutes. Suitable non-oxidizing gas is selected from the group consisting of nitrogen, $CO_2$,and mixtures thereof. These gases are also non-combustible. Low rank coal is such a poor grade of coal that previously a pumpable aqueous slurry feed to the gasifier made from low rank coal would not have more than 45 wt. % solids. Now, however, by the subject process, pumpable aqueous slurries of low rank coal are produced having a solids content of about 55 wt. % solids and more. Increasing the solids content of the feed to the partial oxidation gasifier will significantly increase the efficiency of the process.

It is important that during the grinding and drying steps and also the coating and absorbing steps, which follow, that the surface of the particles of low rank coal be free from exposure to oxygen. Oxidizing the surface of the particles of low rank coal makes them hydrophilic. However, by preventing oxidation the surface of the particles remain hydrophobic. In that state, the particles are more receptive to being coated and for absorbing liquid hydrocarbonaceous fuel oil in the next step. Further, oxidized low rank coal particles, especially lignite, are pyrophoric and have been found to be readily susceptible to degradation and ignition when exposed to elevated drying temperatures in the presence of air.

In one embodiment, the low rank coal is simultaneously ground to size and dried in a hot non-oxidizing gas swept grinding mill, such as a rod mill. Caking of the low rank coal is thereby prevented. Grinding mills are conventional pieces of equipment. For example, see Perry's Handbook Section 8 of Sixth Edition, 1984, McGraw Hill. Conventional grinding mills may be easily provided with a non-oxidizing gas stream to block the coal from contacting air and thereby prevent oxidation of the ground particles of coal.

A hot humidified stream of non-oxidizing gas is separated from the ground low rank coal and contains a significant amount of water, $CO_2$, sulfur-containing gas, and about 0.1 to 5.0 mole % of aromatic and saturated hydrocarbons derived from the low rank coal. The aromatic and saturated hydrocarbons comprise $C_4$ to $C_{20}$ polynuclear aromatics and straight chain saturated hydrocarbons. That portion of the non-oxidizing gas stream leaving the drier or the gas swept grinding mill at a temperature in the range of about 150° F. to 350° F. which is not recycled is cooled by indirect heat exchange with water, LNG, or sea water to a temperature below the dew point. A mixture of water and said aromatic and saturated hydrocarbons condense out. Downstream in the process, this aqueous mixture plus make-up water, if any, is mixed with coated low rank coal particles (to be further described) to produce an aqueous slurry of low rank coal having a solids content of about 50 to 60 wt. %. The heavier hydrocarbons added to the aqueous slurry of low rank coal, at this time will have the beneficial effect of increasing the heating value of the slurry. The water will reduce the fresh make-up water requirement.

The non-oxidizing gas e.g. nitrogen or carbon dioxide cannot be completely recycled to the drier or grinding mill because of a build-up of hydrocarbons. In one embodiment, a stream of raw fuel gas comprising $H_2+CO$ is produced by the partial oxidation of the aqueous slurry of low rank coal. The raw fuel gas may be purified in a conventional acid-gas recovery unit to remove sulfur-containing gases. The purified fuel gas is then introduced into the combustor of a gas turbine for the production of power. Simultaneously, at least a portion e.g. 10 to 100 volume % of the non-oxidizing gas from the coal drier or grinding mill is cooled and dehumidified to separate out water and liquid hydrocarbons, compressed, and separately introduced into the combustor of a combustion turbine. By this means the non-oxidizing gas stream will moderate the temperature and reduce the formation of $NO_x$ in the combustor. This process, for example, will have the beneficial effect of decreasing the fresh nitrogen or carbon dioxide requirement for the gas turbine while simultaneously increasing the heating value of the fuel gas and thus the net power output. Should this embodiment result in an increase in $SO_x$ emissions where x is an integer in the range of about 1–3 from the turbine, then the nitrogen or carbon dioxide stream from the drier or gas swept grinding mill may be blended in with the fuel gas stream prior to entering the acid-gas removal zone. The purified stream of non-oxidizing gas enriched fuel gas may be then introduced into the combustor of the gas turbine for the production of mechanical and/or electrical power and the reduction of $NO_x$ gases, where x is an integer from 1 to 3. Complete combustion takes place in the combustor at a temperature in the range of about 1850° F. to 3000° F., such as about 2500° F., and at a pressure in the range of about 175 to 250 psig, such as about 220 psig.

In the embodiment wherein the non-oxidizing gas stream is a $CO_2$ stream instead of nitrogen, the power delivered by the gas turbine is increased since the $CO_2$ has a higher mass than the nitrogen. The $CO_2$ could be obtained by using a slip stream from the $CO_2$ being vented from the sulfur removal unit so that there would be no net increase in $CO_2$ being vented to the atmosphere. An alternate source of $CO_2$ would be obtained by solvent removal from a stream of raw fuel gas that was produced by the partial oxidation of the aqueous slurry of the low rank coal which is produced herein.

In the next step of the process, in a non-oxidizing atmosphere, such as while in contact with a non-oxidizing gas, the ground dried low rank coal particles are coated with an aqueous emulsion of liquid hydrocarbonaceous fuel oil. About 5 to 20 wt. %, say about 8 to 15 wt. % (basis wt. of dry low rank coal particles) of the aqueous emulsion of liquid hydrocarbonaceous fuel oil containing about 30 to 95 wt. % of water and the remainder substantially comprising liquid hydrocarbonaceous fuel oil coats the surface and is absorbed by the ground particles of dried low rank coal. The liquid hydrocarbonaceous fuel oil portion of said aqueous emulsion has an initial boiling point of at least 500° F.; and it is selected from the group consisting of petroleum distillates and residua, crude petroleum, asphalt, tar sand oil, shale oil, and mixtures thereof. This coating step must be done in a vessel containing a non-oxidizing gas atmosphere.

The particles of low rank coal containing a coating and an absorbed amount of aqueous emulsion of liquid hydrocarbonaceous fuel oil are dried in a conventional drier by direct contact with a non-oxidizing gas at a temperature in the range of about 210° F. to 400° F. This drying step is important. The drying time is in the range of about 10 minutes to 1 hour. The hot humidified non-oxidizing gas, for example nitrogen, leaving the drier at a temperature in the range of about 210° F. to 350° F., with or without further heating, is introduced into the low rank coal heater or into the gas swept grinding mill in the first step of the process. Next, the dried particles of cooled low rank coal containing an absorbed amount of liquid hydrocarbonaceous fuel oil are mixed with water to produce a pumpable slurry having a solids content in the range of about 50 to 60 wt. %. Advantageously, at least a portion of the water carrier for this slurry is obtained by drying the low rank coal as originally supplied. Optionally, the remaining portion of water may be obtained by condensing water out of the moist synthesis gas stream leaving the gasifier. Only a small amount of the water is make-up water, e.g. less than about 10 wt. %. Thus, the non-oxidizing gas used in the grinding and drying of the raw low rank coal is cooled below the dew point to condense out water and aromatic and saturated hydrocarbons. This condensate is used to produce the pumpable aqueous slurry from the dried coated particles of low rank coal.

The pumpable aqueous slurry of coated particles of low rank coal is reacted by partial oxidation with a free-oxygen containing gas in the reaction zone of a free-flow partial oxidation gas generator to produce a stream of synthesis gas, fuel gas, or reducing gas. The temperature in the reaction zone of the partial oxidation gas generator is in the range of about 1800° F.-3000° F. and the pressure is in the range of about 1 to 250 atmospheres. The atomic ratio of free-oxygen in the oxidant to carbon in the feedstock (O/C, atom/atom) is preferably in the range of about 0.6 to 1.5, such as about 0.80 to 1.3. The free oxygen containing gas or oxidant is selected from the group consisting of air, oxygen-enriched air, i.e., greater than 21 to 95 mole % $O_2$, and substantially pure oxygen, i.e. greater than 95 mole % $O_2$. The effluent gas stream leaving the partial oxidation gas generator has the following composition in mole % depending on the amount and composition of the feed streams: $H_2$ 8.0 to 60.0; CO 8.0 to 70.0; $CO_2$ 1.0 to 50.0, $H_2O$ 2.0 to 75.0, $CH_4$ 0.0 to 30.0, $H_2S$ 0.1 to 2.0, COS 0.05 to 1.0, $N_2$ 0.0 to 80.0, and A 0.0 to 2.0.Entrained in the effluent gas stream is particulate matter comprising about 0.5 to 30 wt. %, such as about 1 to 10 wt. % of particulate carbon (basis weight of carbon in the feed to the gas generator). Fly ash particulate matter may be present along with the particulate carbon and molten slag. Conventional gas cleaning and/or purification steps may be employed.

In one embodiment the pumpable aqueous slurry of coated particles of low rank coal contains about 0.05 to 2.0 wt. % of a nonionic surfactant to increase its pumpability and stability. A preferred surfactant is nonionic water soluble alkoxylated alkylphenol, such as ethoxylated nonyl phenol. Suitable nonionic additives have an average molecular weight in the range of about 440 to 6000 and the following structural formula:

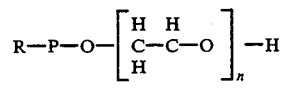

wherein:

R is an alkyl group with 5 to 20 carbon atoms,

P—O is a phenolic moiety in which O is oxygen, and n equals 5 to 100.

EXAMPLES AND DESCRIPTION OF DRAWING

The following examples are offered for a better understanding of the present invention, but the invention is not to be construed as limited thereto.

FIG. 1 of the drawing is a curve of apparent viscosity vs percent solids for aqueous slurries of Wyodak coal, which is a low rank coal conforming with ASTM D388 Class III Subbituminous B coal. Curve A relates to aqueous slurries of Wyodak coal in the as received condition with no treatment. At a pumpable viscosity of 1000 centipoise (cp), the weight percent solids in this slurry is 48.2 wt. %. See Curve A. Unsuitable slurries were prepared by drying the coal particles in air and then mixing them in air with hot asphalt emulsion. The slurry became unstable and the water phase separated. However, when aqueous slurries of Wyodak coal were prepared in accordance with all of the steps in the subject process as claimed and wherein all of the process steps are performed in a non-oxidizing atmosphere including drying the coated particles of low rank coal and with an aqueous asphalt emulsion as the aqueous emulsion of liquid hydrocarbonaceous fuel coating agent, the solids content of the aqueous slurries is greatly increased to 55.3 wt. % when the particles of low rank coal absorb and are coated with 5 wt. % of the aqueous emulsion of asphalt (Curve B), and is increased to 55.6 wt. % when the particles of low rank coal absorb and are coated with 10 wt. % of the aqueous emulsion of asphalt (Curve C).

Various modifications of the invention as hereinbefore set forth may be made without departing from the spirit and scope thereof, and therefore, only such limitations should be made as are indicated in the appended claims.

We claim:

1. A process for the partial oxidation of low rank coal comprising:

(1) grinding low rank coal to a particle size so that 100 wt. % passes through ASTM E11 Standard Sieve Designation 425 microns, and drying said ground low rank coal to a solids content in the range of about 80 to 100 wt. % while said grinding and drying operations are in contact with a non-oxidizing gas at a temperature in the range of about 210° F. to 400° F.; and separating hot humidified non-oxidizing gas containing aromatic and saturated hydrocarbons from the dried ground low rank coal;

(2) contacting in a non-oxidizing atmosphere said ground particles of dried low rank coal from (1) with an aqueous emulsion of liquid hydrocarbonaceous fuel oil containing about 30 to 95 wt. % of water and the remainder substantially comprising liquid hydrocarbonaceous fuel oil, whereby said particles of low rank coal absorb about 5 to 20 wt % (basis wt. of dry low rank coal particles) of said aqueous emulsion of liquid hydrocarbonaceous fuel oil and are thereby coated;

(3) drying said coated particles of low rank coal from (2) by direct contact with a non-oxidizing gas at a temperature in the range of about 210° F. to 400° F. to a solids content in the range of about 80 to 100 wt. %;

(4) mixing the dried coated particles of low rank coal from (3) with water to produce a pumpable slurry having a solids content in the range of about 50 to 60 wt. %; and (5) reacting by partial oxidation with a free-oxygen containing gas in the reaction zone of a free-flow gas generator the aqueous slurry of coated particles of low rank coal from (4) to produce a stream of synthesis gas, fuel gas or reducing gas.

2. The process of claim 1 provided with the step of grinding said low rank coal in (1) in a rod mill while simultaneously being swept with said non-oxidizing gas.

3. The process of claim 1 wherein said non-oxidizing gas is selected from the group consisting of $N_2$, $CO_2$, and mixtures thereof.

4. The process of claim 1 wherein said low rank coal comprises Class III subbituminous and Class IV Lignitic fuel as shown in Table I of ASTM D388.

5. The process of claim 1 wherein the liquid hydrocarbonaceous fuel oil portion of said aqueous emulsion has an initial boiling point of at least 500° F.

6. The process of claim 1 wherein the liquid hydrocarbonaceous fuel oil portion of said aqueous emulsion is selected from the group consisting of petroleum distillates and residua, crude petroleum, asphalt, tar-sand oil, shale oil, and mixtures thereof.

7. The process of claim 1 wherein after said drying in (3) said non-oxidizing gas with or without additional heating is introduced into a gas swept grinding mill for grinding and drying said low rank coal in (1).

8. The process of claim 7 wherein at least a portion of the non-oxidizing gas leaving said gas swept grinding mill is cooled below the dew point to condense out water and liquid hydrocarbon and to produce a dry stream of non-oxidizing gas.

9. The process of claim 8 wherein said condensed water is mixed with the dried low rank coal in (4) to produce said pumpable slurry.

10. The process of claim 8 wherein said dry stream of non-oxidizing gas is introduced into the combustor of a gas turbine to moderate the temperature and reduce the formation of $NO_x$.

11. The process of claim 8 provided with the steps of mixing said dry stream of non-oxidizing gas with raw fuel gas from said gas generator in (5), purifying said gaseous mixture in an acid-gas removal zone, and introducing the purified non-oxidizing gas-enriched fuel gas into the combustor of a gas turbine for the production of power.

12. The process of claim 1 wherein a nonionic surfactant is introduced into the pumpable slurry in (4).

13. The process of claim 12 wherein said surfactant is a water soluble alkoxylated alkyl phenol in the amount of about 0.05 to 2.0 wt. %.

14. The process of claim 13 wherein said alkoxylated alkyl phenol is ethoxylated nonyl phenol.

15. A process for the partial oxidation of low rank coal and the production of mechanical and/or electrical power comprising:

(1) grinding low rank coal in a nitrogen swept grinding mill to a particle size so that 100 wt. % passes through ASTM E11 Standard Sieve Designation 425 microns, and drying said ground low rank coal to a solids content in the range of about 80 to 100 wt. %; wherein said low rank coal grinding and drying operations take place while in contact with nitrogen gas from (3) at a temperature in the range of about 210° F. to 400° F.; and separating hot humidified nitrogen gas containing aromatic and saturated hydrocarbons from the dried ground low rank coal;

(2) contacting in a non-oxidizing atmosphere said ground particles of dried low rank coal from (1) with an aqueous emulsion of liquid hydrocarbonaceous fuel oil containing about 30 to 95 wt. % of water, wherein the liquid hydrocarbonaceous fuel oil portion of said aqueous emulsion has an initial boiling point of at least 500° F. and is selected from the group consisting of petroleum distillates and residua, crude petroleum, asphalt, tar-sand oil, shale oil, and mixtures thereof; whereby said particles of low rank coal absorb about 5 to 20 wt % (basis wt. of dry low rank coal particles) of said aqueous emulsion of liquid hydrocarbonaceous fuel oil and are thereby coated;

(3) drying said coated particles of low rank coal from (2) by direct contact with a nitrogen gas at a temperature in the range of about 210° F. to 400° F. to a solids content in the range of about 80 to 100 wt. %;

(4) mixing the dried coated particles of low rank coal from (3) with water including at least a portion of the condensed water from (6) to produce a pumpable aqueous slurry of coated particles of low rank coal having a solids content in the range of about 50 to 60 wt. %;

(5) reacting by partial oxidation with a free-oxygen containing gas in the reaction zone of a free-flow gas generator the aqueous slurry of coated particles of low rank coal from (4) to produce a stream of raw fuel gas;

(6) cooling at least a portion of the nitrogen gas leaving the gas swept grinding mill in (1) to a temperature below the dew point; condensing out water and liquid hydrocarbon; and producing a dry stream of nitrogen gas; and (7) mixing said dry stream of nitrogen gas from (6) with raw fuel gas from said gas generator in (5); purifying said gaseous mixture in an acid-gas removal zone; and introducing the purified nitrogen-enriched fuel gas into the combustor of a gas turbine for the production of mechanical and/or electrical power and the reduction of $NO_x$ gases.

16. The process of claim 15 wherein a water soluble nonionic alkoxylated alkyl phenol surfactant in the amount of about 0.05 to 2.0 wt. % is introduced into the pumpable slurry in (4).

17. The process of claim 16 wherein said alkoxylated alkyl phenol is ethoxylated nonyl phenol.

18. The process of claim 16 wherein said surfactant has an average molecular weight in the range of about 440 to 6000 and the following structural formula:

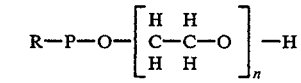

wherein:

R is an alkyl group with 5 to 20 carbon atoms,

P—O is a phenolic moiety in which O is oxygen, and n equals 5 to 100.

* * * * *